US006730467B1

(12) United States Patent
Mydlarz et al.

(10) Patent No.: US 6,730,467 B1
(45) Date of Patent: May 4, 2004

(54) SENSITIZATION OF CUBIC AGCL EMULSIONS WITH IMPROVED WET ABRASION RESISTANCE

(75) Inventors: Jerzy Z. Mydlarz, Fairport, NY (US); Roger L. Klaus, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 894 days.

(21) Appl. No.: 09/013,091

(22) Filed: Jan. 26, 1998

(51) Int. Cl.[7] ..... G03C 1/035
(52) U.S. Cl. ..... 430/569; 430/567
(58) Field of Search ..... 430/569, 567

(56) References Cited

U.S. PATENT DOCUMENTS

| | | | | |
|---|---|---|---|---|
| 2,432,864 A | | 12/1947 | Dimsdale et al. | 430/538 |
| 2,597,915 A | | 5/1952 | Yutzy et al. | 430/567 |
| 4,288,535 A | | 9/1981 | Kanisawa et al. | 430/564 |
| 4,564,591 A | | 1/1986 | Tanaka et al. | 430/567 |
| 4,783,398 A | | 11/1988 | Takada et al. | 430/567 |
| 4,786,588 A | | 11/1988 | Ogawa | 430/567 |
| 4,791,053 A | | 12/1988 | Ogawa | 430/567 |
| 4,863,844 A | | 9/1989 | Okumura et al. | 430/569 |
| 4,868,100 A | * | 9/1989 | Nishijima | 430/550 |
| 4,897,342 A | | 1/1990 | Kajiwara et al. | 430/569 |
| 4,914,016 A | | 4/1990 | Miyoshi et al. | 430/603 |
| 4,962,016 A | | 10/1990 | Chino et al. | 430/603 |
| 5,004,680 A | | 4/1991 | Yagi et al. | 430/567 |
| 5,166,044 A | | 11/1992 | Asami | 430/567 |
| 5,190,855 A | | 3/1993 | Toya et al. | 430/599 |
| 5,192,652 A | | 3/1993 | Kajiwara et al. | 430/551 |
| 5,200,310 A | | 4/1993 | Ohshima | 430/567 |
| 5,204,234 A | | 4/1993 | Asami | 430/567 |
| 5,244,776 A | | 9/1993 | Kawai | 430/363 |
| 5,374,505 A | | 12/1994 | Heinecke et al. | 430/504 |
| 5,382,503 A | | 1/1995 | Murakami et al. | 430/567 |
| 5,391,471 A | | 2/1995 | Ohshima et al. | 430/523 |
| 5,432,052 A | | 7/1995 | Ohshima | 430/567 |
| 5,434,034 A | | 7/1995 | Asami | 430/384 |
| 5,478,702 A | | 12/1995 | Kawai | 430/363 |
| 5,498,516 A | | 3/1996 | Kikuchi et al. | 430/567 |
| 5,550,012 A | | 8/1996 | Suga | 430/567 |
| 5,573,899 A | * | 11/1996 | Kase | 430/517 |
| 5,891,614 A | * | 4/1999 | Ohzeki | 430/569 |

FOREIGN PATENT DOCUMENTS

| | | |
|---|---|---|
| EP | 0 121 435 A1 | 10/1984 |
| EP | 0 244 184 A3 | 11/1987 |
| EP | 0 438 135 B1 | 7/1991 |
| EP | 0 447 105 A1 | 9/1991 |
| EP | 0 613 042 A2 | 8/1994 |

* cited by examiner

*Primary Examiner*—Mark F. Huff
*Assistant Examiner*—Amanda C. Walke
(74) *Attorney, Agent, or Firm*—Paul A. Leipold; Lynne M. Blank

(57) ABSTRACT

The invention relates to a method of forming a silver halide emulsion comprising forming a silver chloride emulsion, adding spectral sensitizing dye, sulfur, and gold sulfide to said emulsion, heating said emulsion to chemically and spectrally sensitize said emulsion, and cooling said emulsion.

9 Claims, No Drawings

SENSITIZATION OF CUBIC AGCL EMULSIONS WITH IMPROVED WET ABRASION RESISTANCE

FIELD OF THE INVENTION

This invention relates to a silver halide photographic light-sensitive material, hereinafter referred to as a light-sensitive material. The invention particularly relates to photographic light-sensitive material which is high in sensitivity and excellent in both gradation and wet pressure resistance.

BACKGROUND OF THE INVENTION

In recent years, there has been demand for a light-sensitive material which is high in image quality, excellent in processing stability and inexpensive in cost and, in particular, for a light-sensitive material capable of being rapidly processable.

To be more specific, an automatic processor is installed at a photofinishing laboratory to process light-sensitive materials. One of the services given to customers is the return of finished films and prints on the same day the photofinishing orders are received and, quite recently, to return them within several hours after receiving the finishing orders, therefore the developments of more rapidly processable light-sensitive materials has been urgently required.

On the other hand, there have been increased instances where light-sensitive materials are liable to mechanical pressure when they are treated in equipment such as printers and automatic processors. When a light-sensitive material is applied with various pressures as mentioned above, the silver halide grains of the light-sensitive material are also applied with a pressure through the binders. i.e., gelatin of the silver halide grains. When the silver halide grains are applied with a pressure, the photographic characteristics of the light-sensitive material are also varied in such a phenomenon as pressure desensitization, pressure fog or the like. Particularly in the case of a rapid processing, the light-sensitive material is liable to a stronger pressure because it is transported faster. This phenomenon has been far well-known as a photographic pressure effect and is described in, for example, T. H. James, "The Theory of Photographic Process" 4th Ed., Macmillan Publishing Co., New York, Paragraph 24; D. Dautrich, F. Granzer and E. Moisar, "Journal of Photographic Science", 21, p. 221, 1973.

Light-sensitive materials are applied with pressure in two cases. i.e., in dried conditions and in wet conditions in which a developing process is being carried out.

Accordingly, there have been attempts to provide light-sensitive materials having more stability against pressure. For example, they are disclosed in Japanese Patent Publication Open to Public Inspection (hereinafter referred to as Japanese Patent O.P.I. Publication) No. 53-13923/1978, a high boiling solvent is contained in an amount of not less than 20% by weight of the binders thereof in a coupler-containing layer; in Japanese Patent Publication No. 57-12133/1982, a coupler and a conversion emulsion are used; in British Patent No. 738,618, a heterocyclic compound is used; in U.S. Pat. No. 2,960,404, a polyhydric alcohol is used; and so forth. However, a fully satisfactory effect has not been obtained from the above-disclosed techniques.

Further Japanese Patent O.P.I. Publication No. 62-250437/1987 discloses a method that a light-sensitive material, which is comprised of a silver halide mainly composed of silver chloride and a water-soluble iridium compound, is hardened with a specific layer hardener. It was, however, found that such a light-sensitive material is still not satisfactory, some effects may be obtained on pressure resistance in wet conditions though, but is still not improved in the pressure resistance in dry conditions and is too low in sensitivity and too soft in contrast to be applied suitably to rapid processing.

Further U.S. Pat. No. 4,962,016 discloses a method that a light-sensitive material, which is comprised of a silver halide mainly composed of silver chloride that is added with elemental sulfur. The term "elementary sulfur" used in that invention, means so-called single element sulfur which is not a form of compound with any other elements. In that invention, therefore, the elemental sulfur does not include any sulfur-containing compounds which are known as the photographic additives in the art. It was found that such a light-sensitive material is satisfactory, some effects may be obtained on pressure resistance both for wet and dry conditions.

PROBLEM TO BE SOLVED BY THE INVENTION

There remains a need for photographic materials that have increased resistance to defects caused by pressure on the photographic material during the developing process. There is also a need for light-sensitive materials that have improved resistance to pressure defects caused by handling prior to developing.

SUMMARY OF THE INVENTION

It is an object of the invention to solve the above-mentioned problems of the prior art so as to provide silver halide photographic light-sensitive material having a high sensitivity, an excellent gradation and an excellent pressure resistance.

These and other objects of the invention are generally accomplished by a method of forming a silver halide emulsion comprising forming a silver chloride emulsion, adding spectral sensitizing dye, sulfur, and gold sulfide to said emulsion, heating said emulsion to chemically and spectrally sensitize said emulsion, and cooling said emulsion.

ADVANTAGEOUS EFFECT OF THE INVENTION

The process of chemical/spectral sensitization of this invention, as described and claimed hereinafter, provides a very effective solution to the problem of pressure sensitivity of high chloride emulsions.

DETAILED DESCRIPTION OF THE INVENTION

This invention can be achieved with a silver halide photographic light-sensitive material comprising a support bearing thereon a photographic component layer including a silver halide emulsion layer, wherein the silver halide emulsion is sensitized with gold-sulfide in the presence of sulfur. The term "sulfur" used in this invention refers to the single substance of sulfur which may or may not be in the form of a compound with any other elements. In this invention, therefore, the "sulfur" includes any sulfur-containing compounds which are known as the photographic addititives in the art, such as a sulfide, sulfuric acid and the salts thereof, sulfurous acid and the salts thereof, thiosulfuric acid and the salts thereof, sulfonic acid and the salts thereof, thioether compounds, thiourea compounds, mercapto compounds, sulfur-containing heterocyclic compounds, and so forth. In this invention, the "sulfur" also includes any sulfur-donating compounds that are applicable for the practice of this invention. Examples of such are those described in U.S. Pat. Nos. 5,443,947 and 5,292,635 that are hereby incorporated by reference. A preferred source of sulfur is sodium thiosulfate, as this material provides very good resistance to pressure in the photographic elements formed using emulsions formed by the method of the invention.

The sulfur of the invention may be present in any suitable amount. The sulfur suitably is present in an amount between 0.05 and 20 mg/silver mole. A preferred amount of sulfur is between 0.1 and 3 mg/silver mole. The preferred sodium disulfide is suitably present in an amount between about 0.5 and 20 mg/silver mole. A preferred amount of the sodium disulfide is between 0.1 and 1.0 mg/silver mole for effective sensitization at low cost.

The invention may be practiced with any of the known techniques for emulsion preparation. Such techniques include those which are normally utilized, for instance single jet or double jet precipitation; or they may include forming a silver halide emulsion by the nucleation of silver halide grains in a separate mixer or first container with later growth in a second container. All these techniques are referenced in the patents discussed in *Research Disclosure*, December 1989, 308119, Sections I–IV at pages 993–1000.

The dispersing medium contained in the reaction vessel prior to the nucleation step is comprised of water, the dissolved chloride ions and a peptizer. The dispersing medium can exhibit a pH within any convenient conventional range for silver halide precipitation, typically from 2 to 8. It is preferred, but not required, to maintain the pH of the dispersing medium on the acid side of neutrality, less than 7.0. To minimize fog a preferred pH range for precipitation is from 2.0 to 5.0. Mineral acids, such as nitric acid or hydrochloric acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions. A summary of conventional peptizers is provided in *Research Disclosure*, Vol. 308, December 1989, Item 308119, Section IX. *Research Disclosure* is published by Kenneth Mason Publications, Ltd., Emsworth, Hampshire PO10 7DD, England. While synthetic polymeric peptizers of the type disclosed by Maskasky U.S. Pat. No. 4,400,463 can be employed, it is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer. These peptizers and their preparation are described by Maskasky U.S. Pat. No. 4,713,323 and King et al. U.S. Pat. No. 4,942,120. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete; however, low levels of methionine (as in oxidized gelatins) are preferred.

The nucleation step can be performed at any convenient conventional temperature for the precipitation of silver halide emulsions. Temperatures ranging from near ambient, e.g., 30° C. up to about 90° C. are contemplated, with nucleation temperatures in the range of from 35 to 70° C. being preferred.

It is usually preferred to prepare photographic emulsions with the most geometrically uniform grain populations attainable, since this allows a higher percentage of the grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

If desired, the physical ripening can be enhanced by the presence of a ripening agent in the emulsion during precipitation. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be effected by employing conventional ripening agents. Preferred ripening agents are sulfur containing ripening agents, such as thioethers and thiocyanates. Typical thiocyanate ripening agents are disclosed by Nietz et al. U.S. Pat. No. 2,222,264; Lowe et al. U.S. Pat. No. 2,448,534; and Illingsworth U.S. Pat. No. 3,320,069, the disclosures of which are here incorporated by reference. Typical thioether ripening agents are disclosed by McBride U.S. Pat. No. 3,271,157; Jones U.S. Pat. No. 3,574,628; and Rosencrantz et al. U.S. Pat. No. 3,737,313, the disclosures of which are here incorporated by reference. More recently crown thioethers disclosed by Herz et al. U.S. Pat. No. 4,782,013 have been suggested for use as ripening agents. Ripening agents containing a primary or secondary amino moiety, such as imidazole, glycine or a substituted derivative, are also effective.

During the growth step both silver and halide salts are preferably introduced into the dispersing medium. In other words, double jet precipitation is contemplated. The rate at which silver and halide salts are introduced is controlled to avoid renucleation that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445, Teitschied et al. European Patent Application 80102242, and Wey "Growth Mechanism of AgBr Crystals in Gelatin Solution", *Photographic Science and Engineering*, Vol. 21, No. 1, January/February 1977, p. 14, et seq.

In the simplest form of grain preparation the nucleation and growth stages of grain precipitation occur in the same reaction vessel. It is, however, recognized that grain precipitation can be interrupted, particularly after completion of the nucleation stage. Further, two separate reaction vessels can be substituted for the single reaction vessel described herein. The nucleation stage of grain preparation can be performed in an upstream reaction vessel (herein also termed a nucleation reaction vessel) and the dispersed grain nuclei can be transferred to a downstream reaction vessel in which the growth stage of grain precipitation occurs (herein also termed a growth reaction vessel). In one arrangement of this type an enclosed nucleation vessel can be employed to receive and mix reactants upstream of the growth reaction vessel, as illustrated by Posse et al. U.S. Pat. No. 3,790,386; Forster et al. U.S. Pat. No. 3,897,935; Finnicum et al. U.S. Pat. No. 4,147,551; and Verhille et al. U.S. Pat. No. 4,171,224, here incorporated by reference. In these arrangements the contents of the growth reaction vessel are recirculated to the nucleation reaction vessel.

It is herein contemplated that various parameters important to the control of grain formation and growth, such as pH, pAg, ripening, temperature, and residence time, can be independently controlled in the separate nucleation and growth reaction vessels. To allow grain nucleation to be entirely independent of grain growth occurring in the growth reaction vessel down stream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208; and published European Patent Applications 326,852; 326,853; 355,535; and 370,116, Ichizo published European Patent Application 0 368 275, Urabe et al. published European Patent Application 0 374 954, and Onishi et al. published Japanese Patent Application (Kokai) 172,817-A (1990). Cooling after sensitization is generally to between about 2 and 8° C.

The emulsions used in the recording elements include silver chloride emulsions, and silver chlorobromide emulsions. Dopants, in concentrations of up to $10^{-2}$ mole per silver mole and typically less than $10^{-4}$ mole per silver mole, can be present in the grains. Compounds of metals such as copper, thallium, lead, mercury, bismuth, zinc, cadmium, rhenium, and Group VIII metals (e.g., iron, ruthenium, rhodium, palladium, osmium, iridium, and platinum) can be present during grain precipitation, preferably during the growth stage of precipitation. The modification of photographic properties is related to the level and location of the dopant within the grains. When the metal forms a part of a coordination complex, such as a hexacoordination complex or a tetracoordination complex, the ligands can also be included within the grains and the ligands can further influence photographic properties. Coordination ligands, such as halo, aquo, cyano cyanate, thiocyanate, nitrosyl, thionitrosyl, oxo and carbonyl ligands are contemplated and can be relied upon to modify photographic properties.

The amount of the sulfur sensitizer can be properly selected according to conditions such as grain size, chemical sensitization temperature, pAg, and pH; chemical sensitization being optionally conducted in the presence of thiocyanate derivatives as described in Damschroder U.S. Pat. No. 2,642,361; thioether compounds as disclosed in Lowe et al. U.S. Pat. No. 2,521,926; Williams et al. U.S. Pat. No. 3,021,215; and Bigelow U.S. Pat. No. 4,054,457; and azaindenes, azapyridazines and azapyrimidines as described in Dostes U.S. Pat. No. 3,411,914; Kuwabara et al. U.S. Pat. No. 3,554,757; Oguchi et al. U.S. Pat. No. 3,565,631; and Oftedahl U.S. Pat. No. 3,901,714; elemental sulfur as described by Miyoshi et al European Patent Application EP 294,149 and Tanaka et al. European Patent Application EP 297,804; and thiosulfonates as described by Nishikawa et al European Patent Application EP 293,917. For the emulsions of this invention high gold finishes are used, with the source of gold sensitizer a colloidal dispersion of gold sulfide.

The emulsions used in the invention can be spectrally sensitized with dyes from a variety of classes, including the polymethine dye class, which includes the cyanines, merocyanines, complex cyanines and merocyanines (i.e., tri , tetra and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphthotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3, 5-dione, pentan-2,4-dione, alkylsulfonyl, acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. An example of a material which is sensitive in the infrared spectrum is shown in Simpson et al. U.S. Pat. No. 4,619,892, which describes a material which produces cyan, magenta and yellow dyes as a function of exposure in three regions of the infrared spectrum (sometimes referred to as "false" sensitization). Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al.

U.S. Pat. No. 2,131,038; Illingsworth et al. U.S. Pat. No. 3,501,310; Webster et al. U.S. Pat. No. 3,630,749; Spence et al. U.S. Pat. No. 3,718,470; and Shiba et al. U.S. Pat. No. 3,930,860.

Among useful spectral sensitizing dyes for sensitizing the emulsions described herein are those found in U.K. Patent 742,112; Brooker U.S. Pat. Nos. 1,846,300; '301; '302; '303; '304; 2,078,233; and 2,089,729, Brooker et al. U.S. Pat. Nos. 2,165,338; 2,213,238; 2,493,747; '748; 2,526,632; 2,739,964 (Reissue 24,292), 2,778,823; 2,917,516; 3,352,857; 3,411,916; and 3,431,111; Sprague U.S. Pat. No. 2,503,776; Nys et al. U.S. Pat. No. 3,282,933; Riester U.S. Pat. No. 3,660,102; Kampfer et al. U.S. Pat. No. 3,660,103; Taber et al. U.S. Pat. Nos. 3,335,010; 3,352,680; and 3,384,486; Lincoln et al. U.S. Pat. No. 3,397,981; Fumia et al. U.S. Pat. Nos. 3,482,978 and 3,623,881; Spence et al. U.S. Pat. No. 3,718,470; and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390; Jones et al. U.S. Pat. No. 2,937,089; Motter U.S. Pat. No. 3,506,443; and Schwan et al. U.S. Pat. No. 3,672,898, the disclosures of which are here incorporated by reference.

Some amounts of spectral sensitizing dyes may remain in the emulsion layers after processing causing, what is known in the art, dye stain. Specifically designed for low stain are dyes disclosed in *Research Disclosure*, Vol. 362, 1994, Item 36216, Page 291.

Spectral sensitizing dyes can be added at any stage during the emulsion preparation, but very different sensitization can result. In general, the spectral sensitizing dyes may be added at the beginning of or during precipitation as described by Wall, Photographic Emulsions, American Photographic Publishing Co., Boston, 1929, p. 65, Hill U.S. Pat. No. 2,735,766; Philippaerts et al. U.S. Pat. No. 3,628,960; Locker U.S. Pat. No. 4,183,756; Locker et al. U.S. Pat. No. 4,225,666; and *Research Disclosure*, Vol. 181, May 1979, Item 18155, and Tani et al. published European Patent Application EP 301,508. They can be added prior to or during chemical sensitization as described by Kofron et al. U.S. Pat. No. 4,439,520; Dickerson U.S. Pat. No. 4,520,098; Maskasky U.S. Pat. No. 4,435,501; and Philippaerts et al. cited above. They can be added before or during emulsion washing as described by Asami et al. published European Patent Application EP 287,100 and Metoki et al. published European Patent Application EP 291,399. The dyes can be mixed in directly before coating as described by Collins et al. U.S. Pat. No. 2,912,343. However, for the emulsions of this invention spectral sensitizing dye is added before or after chemical sensitization depending on the spectral sensitizing dye used. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al. U.S. Pat. No. 3,822,135; or as dispersions as described by Owens et al. U.S. Pat. No. 3,469,987 and Japanese published Patent Application (Kokai) 24185/71.

After sensitizing, the emulsion can be combined with any suitable coupler (whether two or four equivalent) and/or coupler dispersants to make the desired color film or print photographic materials; or they can be used in black and white photographic films and print material. Couplers which can be used in accordance with the invention are described in *Research Disclosure*, Vol. 176, 1978, Section 17643VIII, *Research Disclosure*, 308119 Section VII, and in particular in *Research Disclosure*, Vol. 362, 1994, Item 36216, Page 291.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions used in this invention can also be used in developers and can be classified under a few general headings, as illustrated by C. E. K. Mees, *The Theory of the Photographic Process*, 2nd Ed., Macmillan, 1954, pp. 677 680.

To avoid such instability in emulsion coatings, stabilizers and antifoggants can be employed, such as halide ions (e.g., bromide salts); chloropalladates and chloropalladites as illustrated by Trivelli et al. U.S. Pat. No. 2,566,263; water-soluble inorganic salts of magnesium, calcium, cadmium, cobalt, manganese and zinc as illustrated by Jones U.S. Pat. No. 2,839,405; and Sidebotham U.S. Pat. No. 3,488,709; mercury salts as illustrated by Allen et al. U.S. Pat. No. 2,728,663; selenols and diselenides as illustrated by Brown et al. U.K. Patent 1,336,570; and Pollet et al. U.K. Patent 1,282,303; quaternary ammonium salts of the type illustrated by Allen et al. U.S. Pat. No. 2,694,716; Brooker et al. U.S. Pat. No. 2,131,038; Graham U.S. Pat. No. 3,342,596; and Arai et al. U.S. Pat. No. 3,954,478; azomethine desensitizing dyes as illustrated by Thiers et al. U.S. Pat. No. 3,630,744; isothiourea derivatives as illustrated by Herz et al. U.S. Pat. No. 3,220,839; and Knott et al. U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515; and Hood et al. U.S. Pat. No. 2,751,297; azotriazoles and azotetrazoles as illustrated by Baldassarri et al. U.S. Pat. No. 3,925,086; azaindenes, particularly tetraazaindenes, as illustrated by Heimbach U.S. Pat. No. 2,444,605; Knott U.S. Pat. No. 2,933,388; Williams U.S. Pat. No. 3,202,512; *Research Disclosure*, Vol. 134, June 1975, Item 13452, and Vol. 148, August 1976, Item 14851, and Nepker et al. U.K. Patent 1,338,567; mercaptotetrazoles, -triazoles and -diazoles as illustrated by Kendall et al. U.S. Pat. No. 2,403,927; Kennard et al. U.S. Pat. No. 3,266,897; *Research Disclosure*, Vol. 116, December 1973, Item 11684, Luckey et al. U.S. Pat. No. 3,397,987; and Salesin U.S. Pat. No. 3,708,303; azoles as illustrated by Peterson et al. U.S. Pat. No. 2,271,229; and *Research Disclosure*, Item 11684, cited above; purines as illustrated by Sheppard et al. U.S. Pat. No. 2,319,090; Birr et al. U.S. Pat. No. 2,152,460; *Research Disclosure*, Item 13452, cited above, and Dostes et al. French Patent 2,296,204; polymers of 1,3-dihydroxy(and/or 1,3-carbamoxy)-2-methylenepropane as illustrated by Saleck et al. U.S. Pat. No. 3,926,635; and tellurazoles, tellurazolines, tellurazolinium salts, and tellurazolium salts as illustrated by Gunther et al. U.S. Pat. No. 4,661,438; aromatic oxatellurazinium salts as illustrated by Gunther, U.S. Pat. No. 4,581,330; and Przyklek-Elling et al. U.S. Pat. Nos. 4,661,438 and 4,677,202. High-chloride emulsions can be stabilized by the presence, especially during chemical sensitization, of elementary sulfur as described by Miyoshi et al. European published Patent Application EP 294,149 and Tanaka et al. European published Patent Application EP 297,804 and thiosulfonates as described by Nishikawa et al. European published Patent Application EP 293,917.

In their simplest form photographic elements of the invention employ a single silver halide emulsion layer sensitized with gold sulfide in the presence of sulfur and a support. The gold sulfide is suitably used in an amount between 0.1 and 100 mg/mol Ag. A preferred amount for best chemical sensitization is between 1 and 60 mg/mol Ag. It is, of course, recognized that more than one such silver halide emulsion layer can be usefully included. Where more than one emulsion layer is used (e.g., two emulsion layers) all such layers can be comprised of emulsion sensitized with gold sulfide in the presence of sulfur. However, the use of one or more conventional silver halide emulsion layers, including tabular grain emulsion layers, in combination with one or more high chloride emulsion layers comprising of silver chloride emulsion sensitized with gold sulfide in the presence of sulfur is specifically contemplated.

It is also specifically contemplated to blend the high silver chloride emulsion sensitized with gold sulfide in the presence of sulfur of the present invention with each other or with conventional emulsions to satisfy specific emulsion layer requirements. Instead of blending emulsions, the same effect can usually be achieved by coating the emulsions to be blended as separate layers in an emulsion unit. For example, coating of separate emulsion layers to achieve exposure latitude is well known in the art. It is further well known in the art that increased photographic speed can be realized when faster and slower silver halide emulsions are coated in separate layers. Typically the faster emulsion layer in an emulsion unit is coated to lie nearer the exposing radiation source than the slower emulsion layer. Coating the faster and slower emulsions in the reverse layer order can change the contrast obtained. This approach can be extended to three or more superimposed emulsion layers in an emulsion unit. Such layer arrangements are specifically contemplated in the practice of this invention.

The recording elements used in this invention can contain brighteners (Section V), antifoggants and stabilizers (Section VI), antistain agents and image dye stabilizers (Section VII I and J), light absorbing and scattering materials (Section VIII), hardeners (Section X), coating aids (Section XI), plasticizers and lubricants (Section XII), antistatic agents (Section XIII), matting agents (Section XVI), and development modifiers (Section XXI), all in Research Disclosure, December 1989, Item 308119.

The recording elements used in this invention can be coated on a variety of supports, as described in Section XVII of *Research Disclosure*, December 1989, Item 308119, and references cited therein.

A preferred color paper multilayer format to utilize emulsions of this invention is described in *Research Disclosure*, Vol. 362, 1994, Item#36216, Page 291.

The recording elements used in this invention can be exposed to actinic radiation in a pixel-by-pixel mode as more fully described hereinafter to form a latent image and then processed to form a visible image, as described in Sections XVIII and XIX of *Research Disclosure*, December 1989, Item 308119. Typically, processing to form a visible dye image includes the step of contacting the recording element with a color developing agent to reduce developable silver halide and oxidize the color developing agent. Oxidized color developing agent in turn reacts with the coupler to yield a dye. Preferred color developing agents are p-phenylenediamines. Especially preferred are 4-amino-3-methyl-N,N-diethylaniline hydrochloride, 4-amino-3-methyl-N-ethyl-N-(methanesulfonamido)ethylaniline sulfate hydrate, 4-amino-3-methyl-N-ethyl-N-hydroxyethylaniline sulfate, 4-amino-3-(methanesulfonamido)ethyl-N,N-diethylaniline hydrochloride, and 4-amino-N-ethyl-N-(2-methoxyethyl)m-toluidine di-p-toluenesulfonic acid.

With negative-working silver halide, the processing step described hereinbefore provides a negative image. The described elements can be processed in the color paper process Kodak Ektacolor RA-4 or Kodak Flexicolor color process as described in, for example, the British Journal of Photography Annual of 1988, pages 196–198. To provide a positive (or reversal) image, the color development step can be preceded by development with a non-chromogenic developing agent to develop exposed silver halide but not form dye, and then uniform fogging of the element to render unexposed silver halide developable. The Kodak E-6 Process is a typical reversal process. Development is followed by the conventional steps of bleaching, fixing, or bleach-fixing, to remove silver or silver halide, washing, and drying.

The described elements can be also processed in the ionic separation imaging systems which utilize the sulfonamidonaphthol diffusion transfer technology. Such a photographic product comprises at least one image dye providing element comprising at least one layer of photosensitive silver halide emulsion with which is associated a non-diffusible image dye-providing substance. After image-wise exposure, a coating is treated with an alkaline processing composition in the presence of a silver halide developing agent in such a way that for each dye-image forming element, a silver image is developed. An image-wise distribution of oxidized developer cross-oxidizes the molecule of the image dye-providing compound. This, in an alkaline medium, cleaves to liberate a diffusible dye (U.S. Pat. No. B351,637 by Fleckenstein, Jan. 28, 1975). Other patents include: U.S. Pat. No. 4,450,224 and U.S. Pat. No. 4,463,080; and U.K. Patents 2,026,710 and 2,038,041.

In a similar technology, a silver halide photographic process is combined with LED exposure and thermal development/transfer resulting in a high image quality hard copy system incorporating digital exposure technology. Many patents include U.S. Pat. Nos. 4,904,573; 4,952,969; 4,732,846; 4,775,613; 4,439,513; 4,473,631; 4,603,103; 4,500,626; and 4,713,319 (Fujix Pictography).

The recording elements comprising the radiation sensitive silver halide emulsions sensitized chemically with gold sulfide in the presence of sulfur according to this invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892, incorporated herein by reference. Suitable exposures include those up to 2000 nm, preferably up to 1500 nm. The exposing source needs, of course, to provide radiation in only one spectral region if the recording element is a monochrome element sensitive to only that region (color) of the electromagnetic spectrum. Imagewise exposures at ambient, elevated or reduced temperatures and/or pressures can be employed within the useful response range of the recording element determined by conventional sensitiometric techniques, as illustrated by T. H. James, *The Theory of the Photographic Process*, 4th Ed., Macmillan, 1977, Chapters 4, 6, 17, 18 and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^{-2}$ ergs/cm$^2$. Exposure of the recording element in a pixel-by-pixel mode as known in the prior art persists for only a very short duration or time. Typical maximum exposure times are up to 100 seconds, often up to 10 seconds, and frequently up to only 0.5 seconds. Excellent results are achieved with a laser beam at an exposure time of only 0.05 seconds. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235; European Patent Applications 479 167 A1 and 502 508 A1, the disclosures of which are hereby incorporated herein by reference.

A suitable multicolor, multilayer format for a recording element used in a conventional optical printer of this invention is represented by Structure I.

STRUCTURE I

| |
|---|
| Blue-sensitized yellow dye image-forming silver halide emulsion unit |
| Interlayer |
| Green-sensitized magenta dye image-forming silver halide emulsion unit |
| Interlayer |
| Red-sensitized cyan dye image-forming silver halide emulsion unit |
| ///// Support ///// |

wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are typically separated from each other by interlayers, as shown.

In the practice of the present invention, a high silver chloride emulsion sensitized chemically with gold sulfide in the presence of sulfur in reactive association with a dye image-forming compound can be contained in the green-sensitized silver halide emulsiqn unit only, or it can be contained in each of the silver halide emulsion units.

Another useful multicolor, multilayer format for an element of the invention is the so-called inverted layer order represented by Structure II.

STRUCTURE II

| |
|---|
| Green-sensitized magenta dye image-forming silver halide emulsion unit |
| Interlayer |
| Red-sensitized cyan dye image-forming silver halide emulsion unit |
| Interlayer |
| Blue-sensitized yellow dye image-forming silver halide emulsion unit |
| ///// Support ///// |

wherein the blue-sensitized, yellow dye image-forming silver halide unit is situated nearest the support, followed next by the red-sensitized, cyan dye image-forming unit, and uppermost the green-sensitized, magenta dye image-forming unit. As shown, the individual units are typically separated from one another by interlayers.

As described above for Structure I, a silver chloride emulsion chemically sensitized with gold sulfide in the presence of sulfur can be located in the green-sensitized silver halide emulsion unit, or it can be in each of the units.

Still another suitable multicolor, multilayer format for an element of the invention is illustrated by Structure III.

STRUCTURE III

| |
|---|
| Red-sensitized cyan dye image-forming silver halide emulsion unit |
| Interlayer |
| Green-sensitized magenta dye image-forming silver halide emulsion unit |
| Interlayer |
| Blue-sensitized yellow dye image-forming silver halide emulsion unit |
| ///// Support ///// |

wherein the blue-sensitized, yellow dye image-forming silver halide unit is situated nearest the support, followed next by the green-sensitized, magenta dye image-forming unit, and uppermost the red-sensitized, cyan dye image-forming unit. As shown, the individual units are typically separated from one another by interlayers.

As described above for Structures I and II, a silver chloride emulsion sensitized with gold sulfide in the presence of sulfur can be located in the green-sensitized silver halide emulsion unit, or it can be in each of the units.

Three additional useful multicolor, multilayer formats are represented by Structures IV, V, and VI.

STRUCTURE IV

| |
|---|
| $IR^1$-sensitized yellow dye image-forming silver halide emulsion unit |
| Interlayer |
| $IR^2$-sensitized magenta dye image-forming silver halide emulsion unit |
| Interlayer |
| $IR^3$-sensitized cyan dye image-forming silver halide emulsion unit |
| ///// Support ///// |

STRUCTURE V

| |
|---|
| $IR^1$-sensitized magenta dye image-forming silver halide emulsion unit |
| Interlayer |
| $IR^2$-sensitized cyan dye image-forming silver halide emulsion unit |
| Interlayer |
| $IR^3$-sensitized yellow dye image-forming silver halide emulsion unit |
| ///// Support ///// |

STRUCTURE VI

| |
|---|
| $IR^1$-sensitized cyan dye image-forming silver halide emulsion unit |
| Interlayer |
| $IR^2$-sensitized magenta dye image-forming silver halide emulsion unit |
| Interlayer |
| $IR^3$-sensitized yellow dye image-forming silver halide emulsion unit |
| ///// Support ///// |

Structures IV, V, and VI are analogous to the above-described Structures I, II and III, respectively, except that the three emulsion units are sensitized to different regions of the infrared (IR) spectrum. Alternatively, only one or two of the emulsion units in Structures IV, V, and VI may be IR-sensitized, the remaining unit(s) being sensitized in the visible. As with Structures I, II, and III, Structures IV, V, and VI may contain silver chloride emulsion sensitized with gold sulfide in the presence of sulfur in the lowermost silver halide emulsion unit, or in the uppermost emulsion unit, or in each of the silver halide emulsion units. Also, as previously discussed, the emulsion units of Structures I–VI can individually comprise a multiplicity of silver halide emulsion layers of differing sensitivity and grain morphology.

The following examples illustrate the practice of this invention. They are not intended to be exhaustive of all possible variations of the invention. Parts and percentages are by weight unless otherwise indicated.

The following Tests are used in the Examples:

The Wet Abrasion Test

The test jig consists of an array of 1/16-inch ballbearing-tipped styli mounted in a fixture in a 4C processor using flooded RA4 chemistry. The coating passes out of the developer at 10 seconds of development, runs under the styli in the jig, and returns to developer. The weights applied to the styli range from 6 to 60 grams. The weights applied to obtain a mark, and the density of the mark are reported. Higher weights and lower densities indicate reduced sensitivity to wet abrasion. The wet abrasion mark produced in this test is about 300 microns wide regardless of weight applied, and gains in developed density with increasing weight applied.

Analysis Procedure

A five-step density region is imaged for each sample. This region is dependent upon the sample type (cyan, magenta, yellow) and is based upon initial analyses used to optimize the step region best suited for this test.

A green (550 nm +/−10 nm) interference filter is used to optimize contrast and to loosely approximate visual response. The advantage is a measurement more sensitive than the human eye. Increased sensitivity allows for monitoring the process below the detection limit of the human eye and allows for correlation of analytical data to subtle process changes. A baseline correlation to the visual limit with the analytical results has been established so that we do not detect values that are not revelant to the procedure.

A relative density profile of the step showing the highest contrast is generated by averaging pixels down the step and plotting them across the entire step. The bias (DC offset) is subtracted from the profile and instrument intensity values are converted to relative absorbance (density) as follows:

$$rel.\ abs. = -\log_{10}(I/I_o)$$

where I is the intensity of individual data points, and $I_o$ is the mean intensity across the entire sample. The resulting profile displays optical density changes around the sample mean which has now been normalized to zero. The first derivative (Savitsky-Golay, *Anal. Chem.*, 36, 1627, 1964) of the profile is then calculated. Based upon the above stated spatial resolution, we get about 5–6 pixels across each line. The first derivative is calculated using a sliding scale of 11 data points. The result is a new profile showing peaks enhanced significantly above the background noise. This step also corrects out the overall shape of the profile (i.e., smile or frown) thus eliminating the need to develop complex background correction routines. Since the lines are always nominally the same width (to the third decimal place) the peak heights of these first derivative profiles can be used as a measure of severity. It should be noted that this approach will only work provided the line widths do not change significantly from weight-to-weight and sample-to-sample.

The x-axis is adjusted to the same scale so that peaks from sample-to-sample overlay. This is done so that as we further automate the procedure, width-wise location can be used as a peak locator. The standard deviation of a representative portion of the background of the first derivative profile is calculated. Initial sample analyses showed that the peak height measure is only one part of the analysis. Many cases were noted where the background peak-to-peak signal was significantly different though the peak heights were identical. Using just the peak heights would have resulted in reporting the same severity value for samples that look significantly different by eye. Therefore the first derivative profiles are divided by the standard deviation of the background to give a new metric which takes background shift into account. Then, using the processing method, we developed the analysis as follows:

1) Calculate the peak/standard deviation background ratio.

2) Measure this ratio at the peaks of interest

Analysis of a control sample shows precision to be 10–15% relative for values greater than about 5 and 20–25% relative for values smaller than 4.

Equipment is as follows:

1) 1280×1024×16 μm cooled CCD operating at 1mHz.

2) 14-bits digitization precision.

3) spatial resolution=71 μm/pixel (358# pixels/inch).

4) peltier cooling to −35° C. (minimizes dark current).

5) Instrument: VIEW (visual image enhancement workstation).

6) Illumination: white light (reflected—nominally 45°).

EXAMPLES

The following compounds are utilized in the Examples.

Spectral Sensitizing Dye A=B11774 (KAN 910552)

Spectral Sensitizing Dye B=B21749 (KAN 899712)

Compound I=Bis(sodium p-glutaramidophenyl) disulfide

Emulsion A

This emulsion demonstrates the conventional cubic emulsion precipitated in low methionine gelatin and doped with Compound I for fresh fog control; with osmium (for contrast control); and with iridium (for reciprocity control).

A pure silver chloride emulsion was precipitated by equimolar addition of silver nitrate and sodium chloride into a well-stirred reactor containing gelatin peptizer.

A reaction vessel contained 4.5 L of a solution that was 7.9% in low methionine gelatin, 0.038 M in NaCl. The contents of the reaction vessel were maintained at 55° C. and the pCl was adjusted to 1.7. To this stirred solution at 55° C. 27.7 mL of a solution 2.6 M in $AgNO_3$ and 26.9 mL of a solution 2.8 M in NaCl were added simultaneously at 27.7 mL/min for 1 minute.

Then the 2.6 M silver nitrate solution and the 2.8 M sodium chloride solution were added simultaneously with a ramped linearly increasing flow from 27.7 mL/min to 123 mUmin over 20 minutes. The 2.6 M silver nitrate solution and 2.8 M sodium chloride solution were then added simultaneously at 123 mL/min for 40 minutes. The emulsion was cooled down to 43° C. over 5 minutes. The resulting emulsion was a cubic grain silver chloride emulsion of 0.4 μm in edgelength size. The emulsion was then washed using an ultrafiltration unit, and final pH and pCl were adjusted to 5.6 and 1.7, respectively.

Emulsion B

Same as Emulsion A except that the emulsion was doped with different level of osmium.

Emulsion C

This emulsion demonstrates the undoped conventional cubic emulsion precipitated in regular gelatin.

A pure silver chloride emulsion was precipitated by equimolar addition of silver nitrate and sodium chloride into a well-stirred reactor containing gelatin peptizer.

A reaction vessel contained 4.5 L of a solution that was 7.9% in gelatin, 0.038 M in NaCl. The contents of the reaction vessel were maintained at 47° C. and the pCl was adjusted to 1.7. To this stirred solution at 47° C. 27.7 mL of a solution 2.6 M in $AgNO_3$ and 26.9 mL of a solution 2.8 M in NaCl were added simultaneously at 27.7 mL/min for 1 minute.

Then the 2.6 M silver nitrate solution and the 2.8 M sodium chloride solution were added simultaneously with a ramped linearly increasing flow from 27.7 mumin to 123 mL/min over 20 minutes. The 2.6 M silver nitrate solution and 2.8 M sodium chloride solution were then added simultaneously at 123 mUmin for 40 minutes. The emulsion was cooled down to 43° C. over 5 minutes. The resulting emulsion was a cubic grain silver chloride emulsion of 0.32 μm in edgelength size. The emulsion was then washed using an ultrafiltration unit, and final pH and pCl were adjusted to 5.6 and 1.7, respectively.

Emulsion D

This emulsion demonstrates the conventional ripened AgCl cubic emulsion made in regular gelatin and doped with osmium.

A pure silver chloride emulsion was precipitated by equimolar addition of silver nitrate and sodium chloride into a well-stirred reactor containing gelatin peptizer and an antifoaming pluronic agent.

A reaction vessel contained 7.37 L of a solution that was 4.0% in gelatin, and contained 1.43 mL of antifoaming pluronic agent. The contents of the reaction vessel were maintained at 46.1° C. and the pCl was adjusted to 1.7. The 2.8 M silver nitrate solution and 3.0 M sodium chloride solution were then added simultaneously at 226.1 mL/min for 15.8 minutes. Then the emulsion was cooled down to 40° C. over 5 minutes. The resulting emulsion was a cubic grain silver chloride emulsion of 0.30 μm in edgelength size. The emulsion was then washed using an ultrafiltration unit, and final pH and pCl were adjusted to 5.6 and 1.7, respectively.

SENSITIZATION, COATING FORMULATION, EXPOSURE AND DEVELOPMENT

The emulsions were optimally sensitized by the customary techniques known in the art. Detailed procedures are described below for emulsions of Examples 1–5.

Just prior to coating on resin coated paper support magenta-sensitized emulsions were mixed with magenta dye-forming coupler dispersion containing Coupler A.

Coupler A

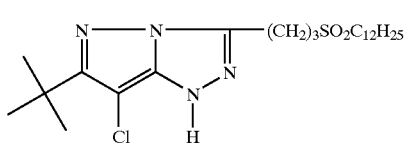

The magenta-sensitized emulsions were coated at 10 mg silver per square foot on resin-coated paper support. The coatings were overcoated with gelatin layer and the entire coating was hardened with bis(vinylsulfonylmethyl)ether.

Coatings were exposed through a step wedge with 3000K tungsten source at exposure time of 0.10 second.

All coatings were processed in KODAK™ Ektacolor RA-4 processing.

Example 1

This example compares silver chloride cubic emulsions precipitated in low methionine gelatin and doped with osmium and iridium compounds during precipitation and sensitized for magenta color record. The sensitization details were as follows:

Part 1.1: A portion of silver chloride Emulsion A was optimally sensitized by the addition of the optimum amount of green Spectral Sensitizing Dye A followed by addition of the optimum amount of colloidal gold sulfide. The emulsion was heated to 60° C. for 30 minutes, and then was cooled down to 40° C. and 1-(3-acetamidophenyl)-5-mercaptotetrazole was added followed by addition of potassium bromide.

Part 1.2: A portion of silver chloride Emulsion A was sensitized identically as in Part 1.1 except that 0.1 mg of sodium thiosulfate, pentahydrate/Ag mole was added after dye but before gold sulfide.

Part 1.3: A portion of silver chloride Emulsion A was sensitized identically as in Part 1.1 except that 0.5 mg of sodium thiosulfate, pentahydrate/Ag mole was added after dye but before gold sulfide.

Part 1.4: A portion of silver chloride Emulsion A was sensitized identically as in Part 1.1 except that 1.0 mg of sodium thiosulfate, pentahydrate/Ag mole was added after dye but before gold sulfide.

Part 1.5: A portion of silver chloride Emulsion A was sensitized identically as in Part 1.1 except that 2.0 mg of sodium thiosulfate, pentahydrate/Ag mole was added after dye but before gold sulfide.

Wet abrasion sensitivity data are summarized in Table I.

TABLE I

| Emulsion finish | mg $Na_2S_2O_3$/ Ag mole | Peak heights/Standard Deviation of 1st derivative data 6 g | 10 g | 15 g | 20 g |
|---|---|---|---|---|---|
| Part 1.1 | 0 | 8.67 | 10.50 | 13.00 | 14.50 |
| Part 1.2 | 0.1 | 2.90 | 6.96 | 9.45 | 8.95 |
| Part 1.3 | 0.5 | <2 | 4.74 | 6.35 | 6.26 |
| Part 1.4 | 1.0 | <2 | 3.59 | 6.53 | 6.19 |
| Part 1.5 | 2.0 | <2 | 4.31 | 8.12 | 8.60 |

In general, the lower the number of the height peak, the lighter the mark on the paper, which means that the emulsion is less sensitive to wet abrasion. The height of a peak smaller than 2 is considered within the noise of the measurement.

Gold sulfide-sensitized silver chloride cubic emulsions made in low methionine gelatin exhibit some beneficial effect of thiosulfate incorporation into the grain surface during sensitization in the magenta finish format. Presence of thiosulfate in the finish significantly reduces magenta wet abrasion sensitivity when the thiosulfate level is less than about 1.0 mg thiosulfate/Ag mole.

Example 2

This example compares silver chloride cubic emulsions precipitated in low methionine gelatin and doped with osmium and iridium compounds during precipitation and sensitized for magenta color record. The sensitization details were as follows:

Part 2.1: A portion of silver chloride Emulsion B was sensitized identically as in Part 1.1.

Part 2.2: A portion of silver chloride Emulsion B was sensitized identically as in Part 1.1 except that 0.1 mg of sodium thiosulfate, pentahydrate/Ag mole was added after dye but before gold sulfide.

Part 2.3: A portion of silver chloride Emulsion B was sensitized identically as in Part 1.1 except that 0.5 mg of sodium thiosulfate, pentahydrate/Ag mole was added after dye but before gold sulfide.

Part 2.4: A portion of silver chloride Emulsion B was sensitized identically as in Part 1.1 except that 1.0 mg of sodium thiosulfate, pentahydrate/Ag mole was added after dye but before gold sulfide.

Wet abrasion sensitivity data are summarized in Table II.

TABLE II

| Emulsion finish | mg $Na_2S_2O_3$/ Ag mole | Peak heights/Standard Deviation of 1st derivative data 6 g | 10 g | 15 g | 20 g |
|---|---|---|---|---|---|
| Part 2.1 | 0 | <2 | 9.13 | 12.20 | 14.20 |
| Part 2.2 | 0.1 | <2 | 8.54 | 11.80 | 14.40 |
| Part 2.3 | 0.5 | <2 | 5.36 | 9.34 | 9.50 |
| Part 2.4 | 1.0 | <2 | 7.73 | 11.7 | 13.2 |

Gold sulfide-sensitized silver chloride cubic emulsions made in low methionine gelatin exhibit some beneficial effect of sodium thiosulfate, pentahydrate incorporation into the grain surface during sensitization in the magenta finish format. Presence of sodium thiosulfate, pentahydrate in the finish significantly reduces magenta wet abrasion sensitivity when the sodium thiosulfate, pentahydrate level is less than about 1.0 mg sodium thiosulfate, pentahydrate/Ag mole.

Example 3

This example compares silver chloride cubic emulsions precipitated in low methionine gelatin and doped with osmium and iridium compounds during precipitation and sensitized for magenta color record. The sensitization details were as follows:

Part 3.1: A portion of silver chloride Emulsion A was sensitized identically as in Part 1.1 except that emulsion was sensitized with Spectral Sensitizing dye B.

Part 3.2: A portion of silver chloride Emulsion A was sensitized identically as in Part 3.1 except that 0.1 mg of sodium thiosulfate, pentahydrate/Ag mole was added after dye but before gold sulfide.

Part 3.3: A portion of silver chloride Emulsion A was sensitized identically as in Part 3.1 except that 0.5 mg of sodium thiosulfate, pentahydrate/Ag mole was added after dye but before gold sulfide.

Part 3.4: A portion of silver chloride Emulsion A was sensitized identically as in Part 3.1 except that 1.0 mg of sodium thiosulfate, pentahydrate/Ag mole was added after dye but before gold sulfide.

Part 3.5: A portion of silver chloride Emulsion A was sensitized identically as in Part 3.1 except that 2.0 mg of sodium thiosulfate, pentahydrate/Ag mole was added after dye but before gold sulfide.

Wet abrasion sensitivity data are summarized in Table III.

TABLE III

| Emulsion finish | mg $Na_2S_2O_3$/ Ag mole | Peak heights/Standard Deviation of 1st derivative data 6 g | 10 g | 15 g | 20 g |
|---|---|---|---|---|---|
| Part 3.1 | 0 | 9.27 | 12.20 | 13.50 | 14.60 |
| Part 3.2 | 0.1 | 7.01 | 11.20 | 12.30 | 14.40 |
| Part 3.3 | 0.5 | 5.86 | 8.28 | 6.57 | 8.68 |
| Part 3.4 | 1.0 | <2 | 4.63 | 6.63 | 7.65 |
| Part 3.5 | 2.0 | 4.46 | 4.86 | 8.36 | 7.85 |

Gold sulfide-sensitized silver chloride cubic emulsions made in low methionine gelatin exhibit some beneficial effect of sodium thiosulfate, pentahydrate incorporation into the grain surface during sensitization in the magenta finish format. Presence of sodium thiosulfate, pentahydrate in the finish significantly reduces magenta wet abrasion sensitivity when the sodium thiosulfate, pentahydrate level is less than about 1.0 mg sodium thiosulfate, pentahydrate/Ag mole, and then increases the wet abrasion sensitivity with higher levels of sodium thiosulfate, pentahydrate.

Example 4

This example compares silver chloride cubic emulsions precipitated in regular gelatin and sensitized for magenta color record. The sensitization details were as follows:

Part 4.1: A portion of silver chloride Emulsion C was sensitized identically as in Part 1.1.

Part 4.2: A portion of silver chloride Emulsion C was sensitized identically as in Part 1.1 except that 0.1 mg of sodium thiosulfate, pentahydrate/Ag mole was added after dye but before gold sulfide.

Part 4.3: A portion of silver chloride Emulsion C was sensitized identically as in Part 1.1 except that 0.5 mg of sodium thiosulfate, pentahydrate/Ag mole was added after dye but before gold sulfide.

Part 4.4: A portion of silver chloride Emulsion C was sensitized identically as in Part 4.1 except that 1.0 mg of sodium thiosulfate, pentahydrate/Ag mole was added after dye but before gold sulfide.

Part 4.5: A portion of silver chloride Emulsion C was sensitized identically as in Part 1.1 except that 2.0 mg of sodium thiosulfate, pentahydrate/Ag mole was added after dye but before gold sulfide.

Wet abrasion sensitivity data are summarized in Table IV.

TABLE IV

| Emulsion | mg $Na_2S_2O_3$/ | Peak heights/Standard Deviation of 1st derivative data | | | |
|---|---|---|---|---|---|
| finish | Ag mole | 6 g | 10 g | 15 g | 20 g |
| Part 4.1 | 0 | 3.54 | 7.03 | 7.26 | 9.27 |
| Part 4.2 | 0.1 | 2.84 | 5.35 | 3.89 | 4.54 |
| Part 4.3 | 0.5 | 2.57 | 3.97 | 2.91 | 3.94 |
| Part 4.4 | 1.0 | 2.43 | 4.54 | 5.49 | 6.46 |
| Part 4.5 | 2.0 | 4.07 | 5.64 | 6.19 | 6.52 |

Gold sulfide-sensitized silver chloride cubic emulsions made in regular gelatin exhibit some beneficial effect of sodium thiosulfate, pentahydrate incorporation into the grain surface during sensitization in the magenta finish format. Presence of sodium thiosulfate, pentahydrate in the finish significantly reduces magenta wet abrasion sensitivity when the sodium thiosulfate, pentahydrate level is less than about 1.0 mg sodium thiosulfate, pentahydrate/Ag mole and then increases the wet abrasion sensitivity with higher levels of sodium thiosulfate, pentahydrate.

Example 5

This example compares silver chloride cubic emulsions precipitated in regular gelatin and sensitized for magenta color record. The sensitization details were as follows:

Part 5.1: A portion of silver chloride Emulsion D was melted at 40° C. and then sensitized by the addition of the optimum amount of colloidal gold sulfide. Then the emulsion was heated to 55° C. over 12 minutes and held at this temperature for 27 minutes. Then an iridium compound was added followed by addition of Lippmann silver bromide, followed by addition of Spectral Sensitizing Dye A, followed by addition of 1-(3-acetamidophenyl)-5-mercaptotetrazole. Then the emulsion was cooled to 40° C.

Part 5.2: A portion of silver chloride Emulsion D was sensitized identically as in Part 5.1 except that 0.2 mg of sodium thiosulfate, pentahydrate/Ag mole was added before gold sulfide.

Part 5.3: A portion of silver chloride Emulsion D was sensitized identically as in Part 5.1 except that 0.5 mg of sodium thiosulfate, pentahydrate/Ag mole was added before gold sulfide.

Part 5.4: A portion of silver chloride Emulsion D was sensitized identically as in Part 4.1 except that 1.0 mg of sodium thiosulfate, pentahydrate/Ag mole was added before gold sulfide.

Part 5.5: A portion of silver chloride Emulsion D was sensitized identically as in Part 5.1 except that 1.5 mg of sodium thiosulfate, pentahydrate/Ag mole was added before gold sulfide.

Wet abrasion sensitivity data are summarized in Table V.

TABLE V

| Emulsion | mg $Na_2S_2O_3$/ | Peak heights/Standard Deviation of 1st derivative data | | | |
|---|---|---|---|---|---|
| finish | Ag mole | 10 g | 20 g | 30 g | 60 g |
| Part 5.1 | 0 | 6.16 | 15.4 | 20.7 | 24.1 |
| Part 5.2 | 0.2 | 4.28 | 14.9 | 18.9 | 22.4 |
| Part 5.3 | 0.5 | 4.91 | 14.0 | 16.4 | 21.8 |
| Part 5.4 | 1.0 | 4.02 | 12.2 | 15.4 | 20.9 |
| Part 5.5 | 1.5 | 2.78 | 11.9 | 13.8 | 16.4 |

Gold sulfide-sensitized silver chloride cubic emulsions made in regular gelatin and in the presence of ripener exhibit some beneficial effect of sodium thiosulfate, pentahydrate incorporation into the grain surface during sensitization in the magenta finish format. Presence of sodium thiosulfate, pentahydrate in the finish significantly reduces magenta wet abrasion sensitivity.

The invention has been described in detail with particular reference to certain preferred embodiments thereof, but it will be understood that variations and modifications can be effected within the spirit and scope of the invention.

What is claimed is:

1. A method of forming a sensitized silver chloride emulsion comprising forming a silver chloride emulsion, adding spectral sensitizing dye, sulfur, and gold sulfide to said emulsion, heating said emulsion to chemically and spectrally sensitize said emulsion, and cooling said emulsion, wherein said sulfur is present in an amount between 0.05 and 20 mg/silver mole, said gold sulfide is present in an amount between 1 and 60 mg/mol Ag, said sulfur comprises sodium thiosulfate and is present in an amount between 0.1 and 1.0 mg/silver mol, and wherein said silver chloride emulsion has grains that comprise greater than 95 percent chloride and are cubic.

2. The method of claim 1 wherein said emulsion comprises oxidized gelatin.

3. The method of claim 1 wherein said sensitizing dye comprises dye sensitive to green light.

4. The method of claim 1 wherein during said cooling of said emulsion 1-(3-acetamidophenyl)-5-mercaptotetrazole and potassium bromide is added to said emulsion.

5. The method of claim 1 wherein said potassium bromide is added in an amount between 200 and 3000 mg/silver mol.

6. The method of claim 1 wherein potassium bromide is added in an amount between 500 and 900 mg/silver mol.

7. The method of claim 4 wherein 1-(3-acetamidophenyl)-5-mercaptotetrazole is added in an amount between 50 and 400 mg/silver mol.

8. The method of claim 4 wherein 1-(3-acetamidophenyl)-5-mercaptotetrazole is added in an amount between 100 and 200 mg/silver mol.

9. The method of claim 1 wherein said cooling is to between 2 and 8° C.

* * * * *